US008091633B2

(12) United States Patent
Al-Khamis

(10) Patent No.: US 8,091,633 B2
(45) Date of Patent: Jan. 10, 2012

(54) TOOL FOR LOCATING AND PLUGGING LATERAL WELLBORES

(75) Inventor: Mohammed Najim Al-Khamis, Ras Tanura (SA)

(73) Assignee: Saudi Arabian Oil Company, Dhahran (SA)

( * ) Notice: Subject to any disclaimer, the term of this patent is extended or adjusted under 35 U.S.C. 154(b) by 265 days.

(21) Appl. No.: 12/396,763

(22) Filed: Mar. 3, 2009

(65) Prior Publication Data

US 2010/0226206 A1 Sep. 9, 2010

(51) Int. Cl.
*E21B 47/00* (2006.01)
*G01V 1/00* (2006.01)

(52) U.S. Cl. ..... 166/250.01; 166/254.1; 166/254.2; 367/25

(58) Field of Classification Search ..... 166/250.01, 166/254.1, 254.2, 250.03, 250.08, 250.09, 166/250.17, 50, 308.1
See application file for complete search history.

(56) References Cited

U.S. PATENT DOCUMENTS

| | | | | |
|---|---|---|---|---|
| 5,311,936 | A | 5/1994 | McNair et al. | |
| 5,353,876 | A | 10/1994 | Curington et al. | |
| 5,388,648 | A | 2/1995 | Jordan, Jr. | |
| 5,411,082 | A * | 5/1995 | Kennedy | 166/181 |
| 5,520,252 | A | 5/1996 | McNair | |
| 5,730,224 | A | 3/1998 | Williamson et al. | |
| 5,944,108 | A | 8/1999 | Baugh et al. | |
| 5,944,109 | A | 8/1999 | Longbottom | |
| 5,964,287 | A | 10/1999 | Brooks | |
| 5,975,208 | A | 11/1999 | Brooks | |
| 5,992,525 | A | 11/1999 | Williamson et al. | |
| 6,002,257 | A | 12/1999 | Thomas et al. | |
| 6,041,860 | A * | 3/2000 | Nazzal et al. | 166/250.01 |
| 6,125,937 | A | 10/2000 | Longbottom et al. | |
| 6,213,205 | B1 | 4/2001 | Surjaatmadja | |
| 6,244,340 | B1 | 6/2001 | McGlothern et al. | |
| 6,263,968 | B1 | 7/2001 | Freeman et al. | |
| 6,401,812 | B2 | 6/2002 | Leising | |
| 6,543,541 | B2 | 4/2003 | Buyers et al. | |
| 6,561,277 | B2 | 5/2003 | Algeroy et al. | |
| 6,712,148 | B2 | 3/2004 | Fipke et al. | |
| 6,942,030 | B2 | 9/2005 | Zupanick | |
| 6,991,048 | B2 | 1/2006 | Zupanick | |
| 7,213,654 | B2 | 5/2007 | Plucheck et al. | |
| 7,231,980 | B2 | 6/2007 | Murray et al. | |
| 7,441,604 | B2 | 10/2008 | Green | |
| 7,497,264 | B2 | 3/2009 | Moody et al. | |
| 2004/0003925 | A1 | 1/2004 | Desai | |

FOREIGN PATENT DOCUMENTS

WO 2008068561 A1 6/2008

OTHER PUBLICATIONS

International Search Report and Written Opinion dated Dec. 27, 2010.

* cited by examiner

*Primary Examiner* — Thomas Beach
*Assistant Examiner* — James Sayre
(74) *Attorney, Agent, or Firm* — Bracewell & Giuliani, LLP

(57) ABSTRACT

A tool used for treating and/or maintaining a wellbore that includes acoustic transducers for locating a lateral wellbore that intersects a primary wellbore. The tool includes a sensor to sense water and/or gas, and if the water and/or gas enters the primary wellbore from a lateral wellbore, the lateral to primary intersection can be identified by correlating information from the sensor and acoustic transducers. If needed, the tool can be used to plug the water and/or gas supplying lateral wellbore. The tool may include a bendable sub portion for orienting a portion of the tool for insertion into the lateral wellbore and a plug section for plugging the lateral wellbore after insertion therein.

20 Claims, 7 Drawing Sheets

TOOL FOR LOCATING AND PLUGGING LATERAL WELLBORES

BACKGROUND OF THE INVENTION

1. Field of the Invention

This invention generally relates to the field of oil and/or gas exploration and production and more specifically relates to an apparatus and method for maintaining a wellbore.

2. Description of the Related Art

Wells drilled for producing oil and/or gas extend from the surface through a subterranean formation where they intersect a hydrocarbon bearing strata. The wells may include one or more lateral wells that intersect a primary wellbore and extend into the formation away from the primary wellbore. The lateral wellbores typically are formed to produce from a particular hydrocarbon laden zone identified away from the primary wellbore. Additionally, utilizing lateral wellbores enables production from a much larger area while limiting drilling costs to a single primary wellbore.

From time to time, however, lateral wellbores may require inspection and/or repair. Locating and entering these lateral wellbores can sometimes be difficult due at least in part to the uncertainties inherent in defining the direction of the lateral within the main wellbore. This is especially so when disposing a downhole tool on coiled tubing or wireline. Known devices available for locating a lateral wellbore include mechanical locators provided within the well that can be identified by various means. With reference now to FIG. 1, an example is shown in a side partial sectional view of a wellbore 2 formed through a subterranean formation 4. In this example, the wellbore 2 comprises a primary wellbore 3 with lateral wellbores 5, 6, 7 intersecting the primary wellbore 3 at various locations along its length.

A wellbore operations system 10 is shown inserted into the wellbore 2. The system includes a downhole tool 18 deployed in the primary wellbore 3 on a length of tubing 14. The tubing 14 is provided from a reel 12 shown threaded through a wellbore tree 16 mounted on the upper end of the wellbore 2. Further illustrated in FIG. 1 is a whipstock 20, which is a simple example of an entry device for directing the tool 18 into the lateral wellbore 7. Also shown in the example of FIG. 1 is water and/or gas 22 emanating from within the lateral wellbore 7 and into the primary wellbore 3. Addressing unwanted water and/or gas production from a lateral well is one example of downhole operations that can be performed in a lateral well.

SUMMARY OF THE INVENTION

Disclosed herein is a method of maintaining a wellbore having a primary wellbore and at least one lateral wellbore intersecting the primary wellbore. The wellbore includes a wall along the inner surface of the primary and lateral wellbores. A downhole tool is put into the primary wellbore and forms an annulus between the tool and the wall in the primary wellbore. The tool may include an acoustic transducer used for generating an acoustic signal directed from the tool to the wellbore wall. When the signal reflects from the wellbore wall a reflection signal is formed and is identifiable when reflected from the lateral wellbore. This embodiment of the method may further include receiving the reflection signal, moving the transducer in an axial direction along the wellbore axis, and repeating the steps of generating, receiving, and moving to create a collection of received signals. From the collection of received signals, a reflection from the wall in the lateral wellbore can be identified to estimate where the lateral wellbore intersects with the primary wellbore. The method may further include analyzing fluid in the wellbore for the presence of water and/or gas. Using the sensed water and/or gas and lateral intersection information it can be determined whether the lateral wellbore produces water and/or gas. The tool may further include a bendable sub and the method further may further involve activating the bendable sub so that activating the bendable sub bends a lower portion of the tool into alignment for insertion into a lateral wellbore. The tool may also further include a wellbore seal and the method can further involve inserting the tool into the lateral wellbore and activating the wellbore seal thereby sealing the lateral wellbore from the primary wellbore. The portion of the tool having the wellbore seal can be separated from the remaining portion of the tool and the remaining portion of the tool can be removed from the lateral wellbore thus leaving the portion of the tool having the wellbore seal in the lateral wellbore.

Also disclosed herein is a downhole tool insertable into a wellbore, the wellbore having a primary wellbore and a lateral wellbore. Included with the tool is a water and/or gas sensor to sense the presence of any water and/or gas flowing from the lateral wellbore and to determine the intersection of the lateral wellbore to the primary. A bendable orienting sub is included with the tool, where the sub bends a lower portion of the tool relative to an upper portion to enter the lateral wellbore. Another feature includable with the tool is a wellbore seal in the lower portion of the tool, which when activated seals the lateral wellbore. The tool further includes a frangible section that releases the lower portion of the tool from the remaining portion to allow the tool to be retrievable while the wellbore seal remains in the lateral wellbore. The tool may optionally include an acoustic signal transmitting and receiving system that emits acoustical signals that are reflected from a wellbore wall to determine the location of a lateral wellbore.

The present disclosure also includes a wellbore system for investigating a wellbore, where the wellbore has a primary well, a lateral well intersecting the primary well, and a wall on the primary well inner periphery and lateral well inner periphery, the system for estimating where the lateral well intersects the primary well. In one embodiment the system has a sonde disposable into the wellbore, an acoustic array provided with the sonde, the array comprising an acoustic transmitter and a corresponding acoustic receiver, the acoustic transmitter positioned so that when it generates an acoustic signal the acoustic signal is directed away from the sonde in a plurality of lateral directions to an adjacent wellbore wall, wherein the acoustic signal contacts the wellbore wall on one of the primary well inner periphery or lateral well inner periphery and reflects from the wellbore wall to form a reflection signal receivable by the acoustic receiver; and a processor in data communication with the array, the processor configured to analyze data communicated from the array to determine if the reflection signal was by the acoustic signal reflecting from the primary wellbore or the lateral wellbore to thereby estimate the location where the lateral wellbore intersects with the primary wellbore.

BRIEF DESCRIPTION OF THE DRAWINGS

So that the manner in which the features, advantages and objects of the invention, as well as others which will become apparent, may be understood in more detail, more particular description of the invention briefly summarized above may be had by reference to the embodiment thereof which is illustrated in the appended drawings, which form a part of this specification. It is to be noted, however, that the drawings illustrate only a preferred embodiment of the invention and is therefore not to be considered limiting of the invention's scope as it may admit to other equally effective embodiments.

DETAILED DESCRIPTION

Disclosed herein is a method and system for locating lateral well to primary well intersection. Also disclosed herein is a system and method for sensing water and/or gas in wellbore fluid and if the water and/or gas is introduced from a lateral wellbore to a primary wellbore, the system and method identifies the particular lateral wellbore introducing the water and/or gas into the primary wellbore. Further included is a bendable sub for a downhole tool, providing orienting for the tool to enter a lateral wellbore. Also, a seal is included for sealing and blocking a lateral wellbore.

Figure 1:
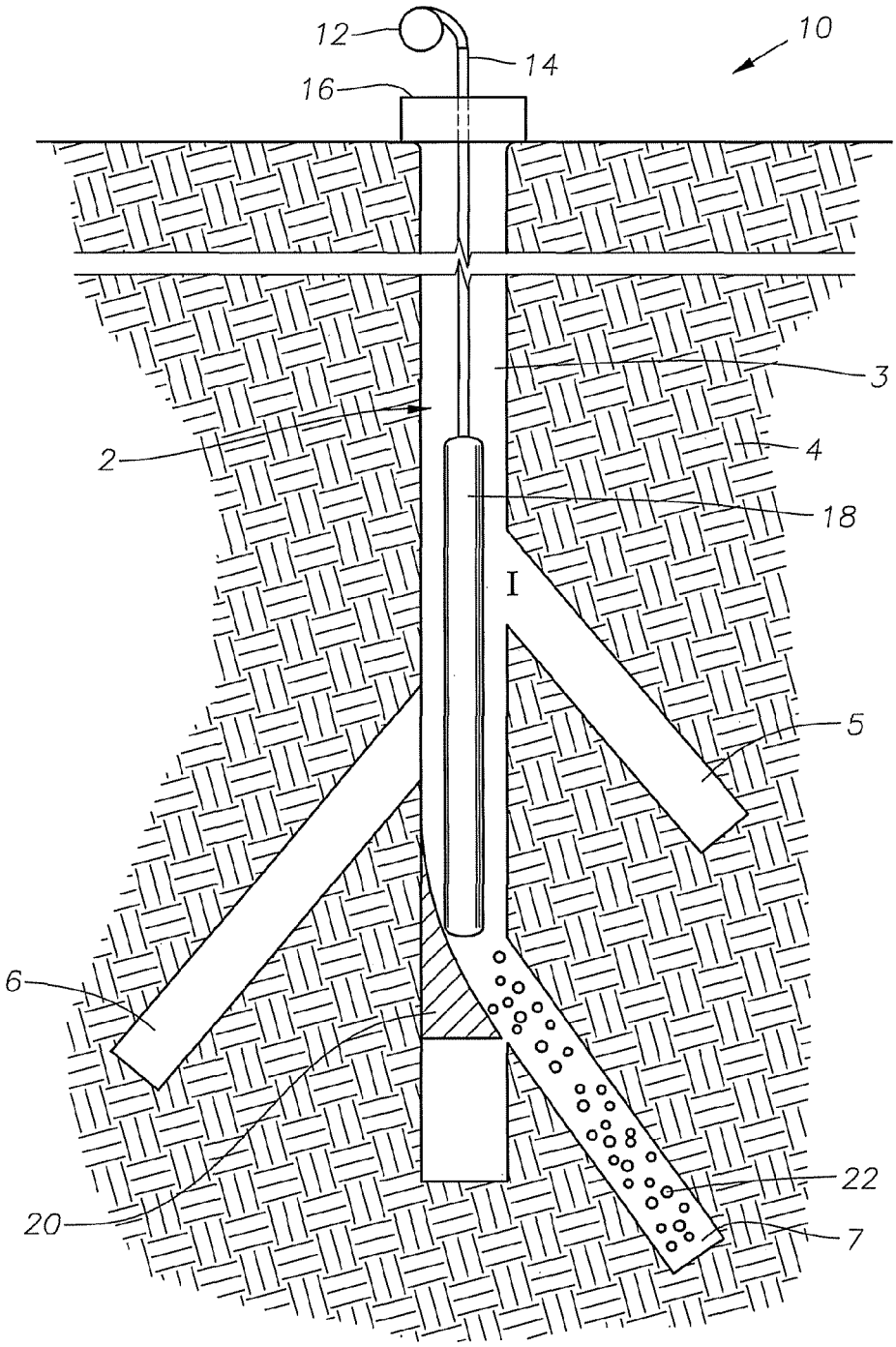
Fig. 1 (Prior Art)
FIG. 1 is a side partial sectional view of a prior art method of deploying a downhole tool into a lateral wellbore.
Figure 2:
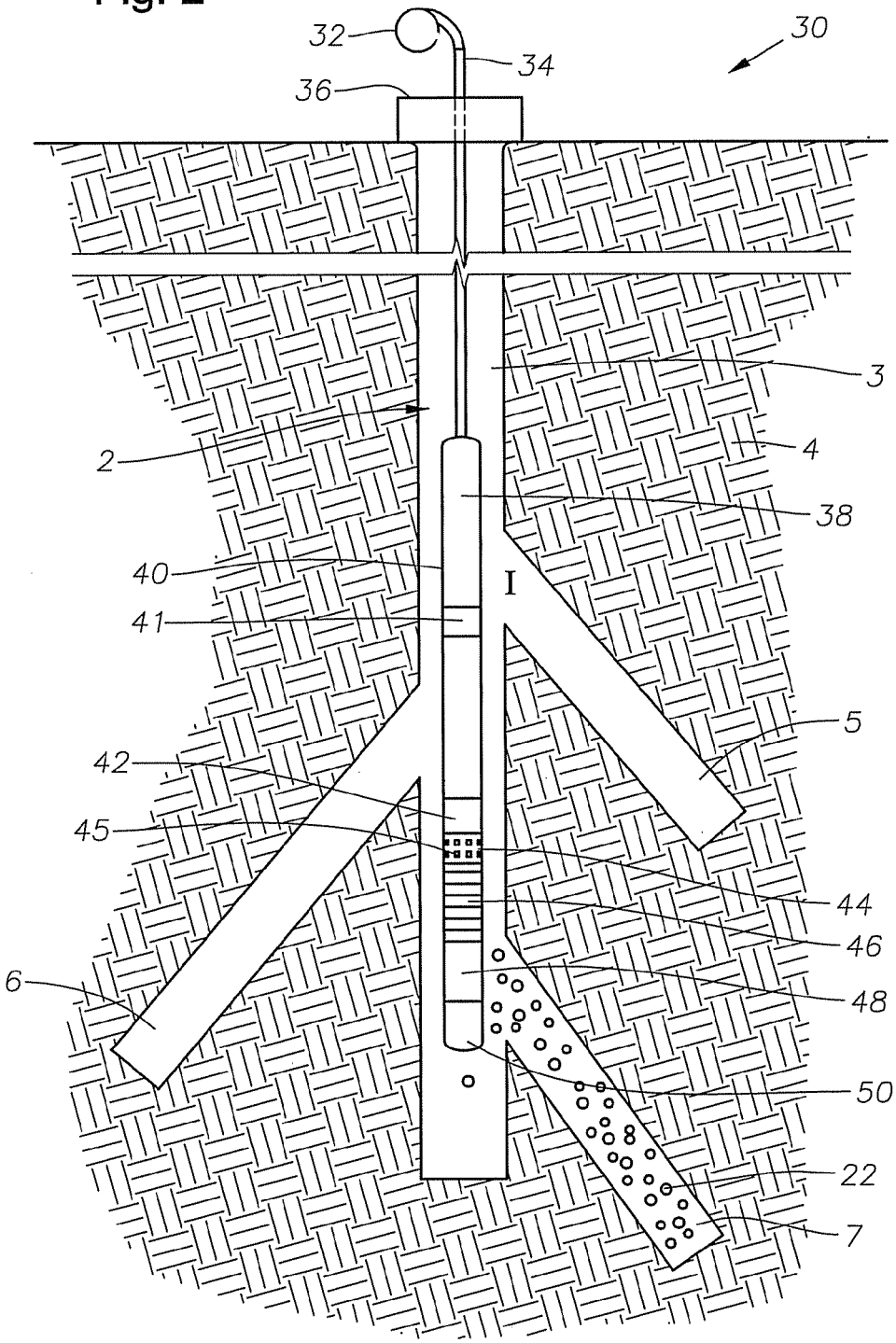
FIG. 2 is a side partial sectional view of an embodiment of a downhole tool described herein disposed in a wellbore.

FIG. 2 illustrates in side partial sectional view an example of a downhole system 30 for use in the wellbore 2. The system 30 includes a downhole tool 38 shown deployed on tubing 34 within the primary wellbore 3. The tubing 34 is supplied from a reel 32 and inserted into the wellbore 2 through a production tree 36 that is affixed on the upper end of the wellbore 2. Optionally, the tool 38 can be lowered on wireline, slickline, or any other lowering and raising means. Downhole tool 38 includes an outer housing 40 having an outer surface defining a sonde. In the embodiment shown, included with the housing 40 are a sensor 42 for sensing water and/or gas, a lateral detector 44, an orienting sub 42, a plug or seal section 48, and a guide shoe 50.

The sensor 42 analyzes wellbore fluid adjacent the tool 38 for detecting the presence of water and/or gas 22 in the fluid. Sensor 42 results may be available real time to the surface via tubing 34 or other telemetry means. Water and/or gas downhole can be identified by neutron and/or gradiometer logging tools. Optionally, the results can be stored within the sensor 42 or other areas of the housing 40 and retrieved and analyzed at a later time. In the embodiment of FIG. 2, the lateral sensor 44 includes an array of acoustic transducers 45. The acoustic transducers 45 include acoustic transmitters and receivers. Optionally, transducers capable of transmitting and receiving acoustic signals may be included. As will be discussed in more detail below, acoustic signals are generated within the primary wellbore 3 and reflected from the wellbore 2 wall, where receivers within the lateral detector 44 receive the reflected acoustic signal. Signals reflecting from the wellbore wall within the primary wellbore have signatures different from the signatures of signals reflecting from the wellbore wall within the lateral wellbores 5, 6, 7. Identifying the position of the lateral detector 44 when receiving acoustic reflections from the wellbore wall in one of the lateral wellbores 5, 6, 7 provides one method of identifying an intersection I between the lateral wellbores 5, 6, 7 and the primary wellbore 3. The wellbore wall can include casing cemented within the borehole.

The orienting sub 46 bends or deflects at an angle relative to the tool axis $A_T$. Multiple ways of incorporating a bendable sub 46 are known. Examples include asymmetric sliding sleeves, lined coiled tubing, mechanically activated bendable portion, or hydraulically activated sections. The seal or plug section 48 provides a manner of sealing within a wellbore, such as a lateral wellbore; an example includes an outwardly expanding inflatable plug that seals against a wellbore along its inner circumference.

In one example of use, the tool 38 traverses the primary wellbore 3, while the lateral detector 44 is activated and generating acoustic signals within the wellbore 2. Analyzing the signal reflections can locate an intersection I between the primary wellbore 3 and one of the lateral wellbores 5, 6, 7. Optionally, the sensor 42 may be simultaneously sampling the wellbore fluid and identifying water and/or gas 22 content. As noted above, analysis results for water and/or gas content or a lateral intersection, can be stored within the housing 40 or directed to the surface for real time analysis. A processor 41, such as an information handling unit, can be employed to conduct the analysis, store the analysis results, provide control commands to communicate the analysis to surface, or any other step of control.

As shown in FIG. 2, the lateral wellbore 7 includes water and/or gas 22 flowing to the primary wellbore 3. Correlating the intersection I location with the location where water and/or gas 22 is sensed can identify the lateral wellbore 7 producing the water and/or gas 22. In one example of use, the tool 38 travels the primary wellbore 3 length to identify lateral to primary wellbore intersections I and water and/or gas presence. The tool 38 travel can be limited to a single in or out sensing/analysis trip, or include additional passes through the wellbore 3 for additional data collection. After identifying the water and/or gas 22 producing lateral wellbore 7, corrective or remedial action can then be undertaken within the lateral wellbore 7. Optionally, the sensor 42 can sense the water and/or gas percent in the wellbore fluid in addition to its presence in the wellbore fluid. Based on the mapping step, one or more lateral wellbores can be identified for corrective action.

Figure 3:
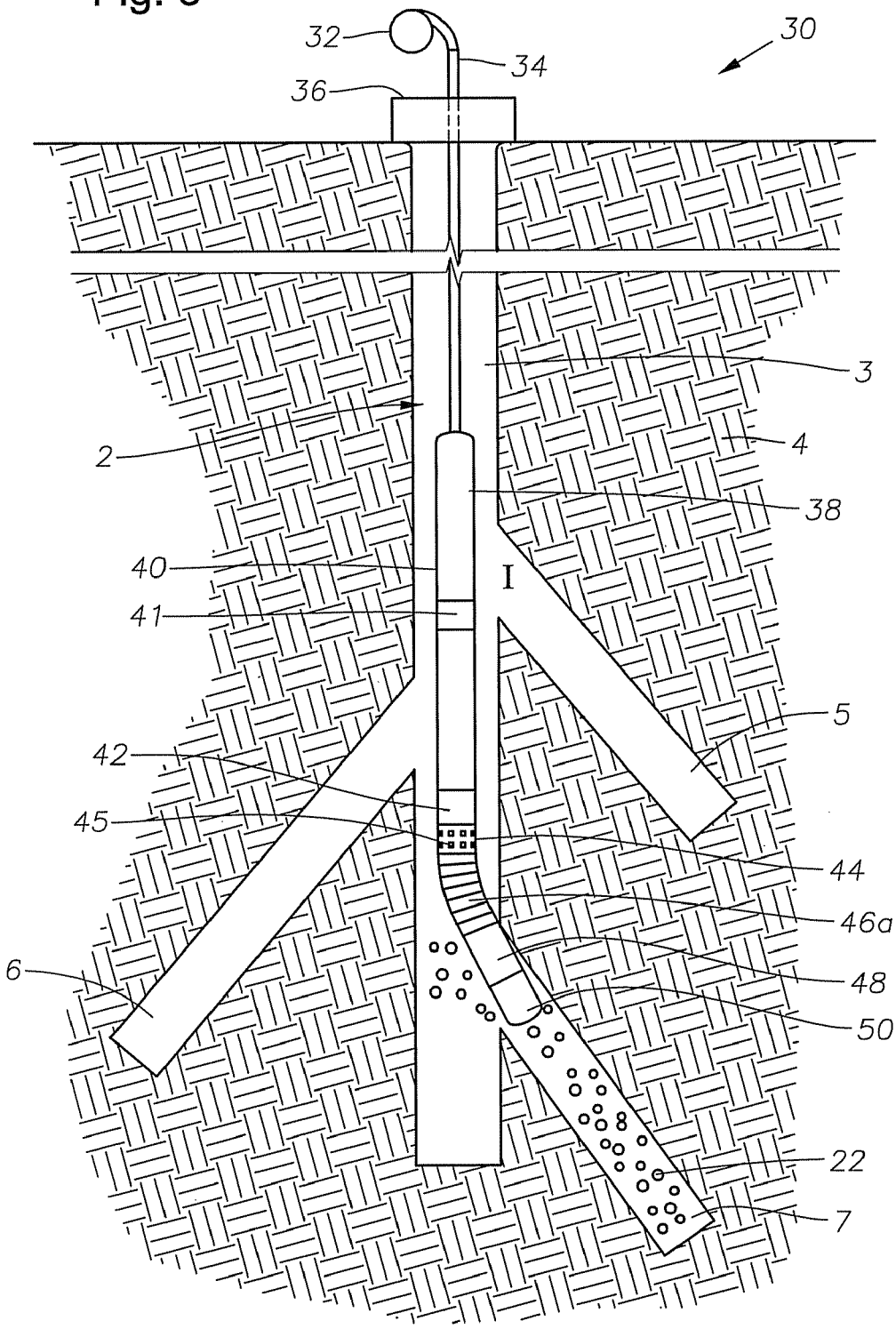
FIGS. 3-5 illustrate the downhole tool in FIG. 2 entering and plugging a lateral wellbore.

FIG. 3 illustrates in side partial sectional view, the tool 38 of FIG. 2 being oriented for insertion into the lateral wellbore 7. Orienting the tool 38 includes bending the tool 38 so its free end may enter the lateral wellbore 7. The tool 38 may be bent by activating the orienting sub **46*a* into a partial bending configuration, thereby orienting the lower or end of the tool 38 having the guide shoe 50. The bending step should angle the tool 38 end so the portion below the orienting sub 46*a* can enter the lateral wellbore 7. This requires a bending angle that considers the angle between the primary wellbore 3 and the lateral wellbore 7 and proper azimuthal direction matching the lateral wellbore 7 entrance. Alignment with the proper azimuthal direction can be from a gyroscope (not shown) or real time acoustic monitoring as described herein. It should be pointed out that tool 38 operation is not limited to insertion into a single lateral wellbore 7**, but instead can be operated in any lateral wellbore.

Figure 4:
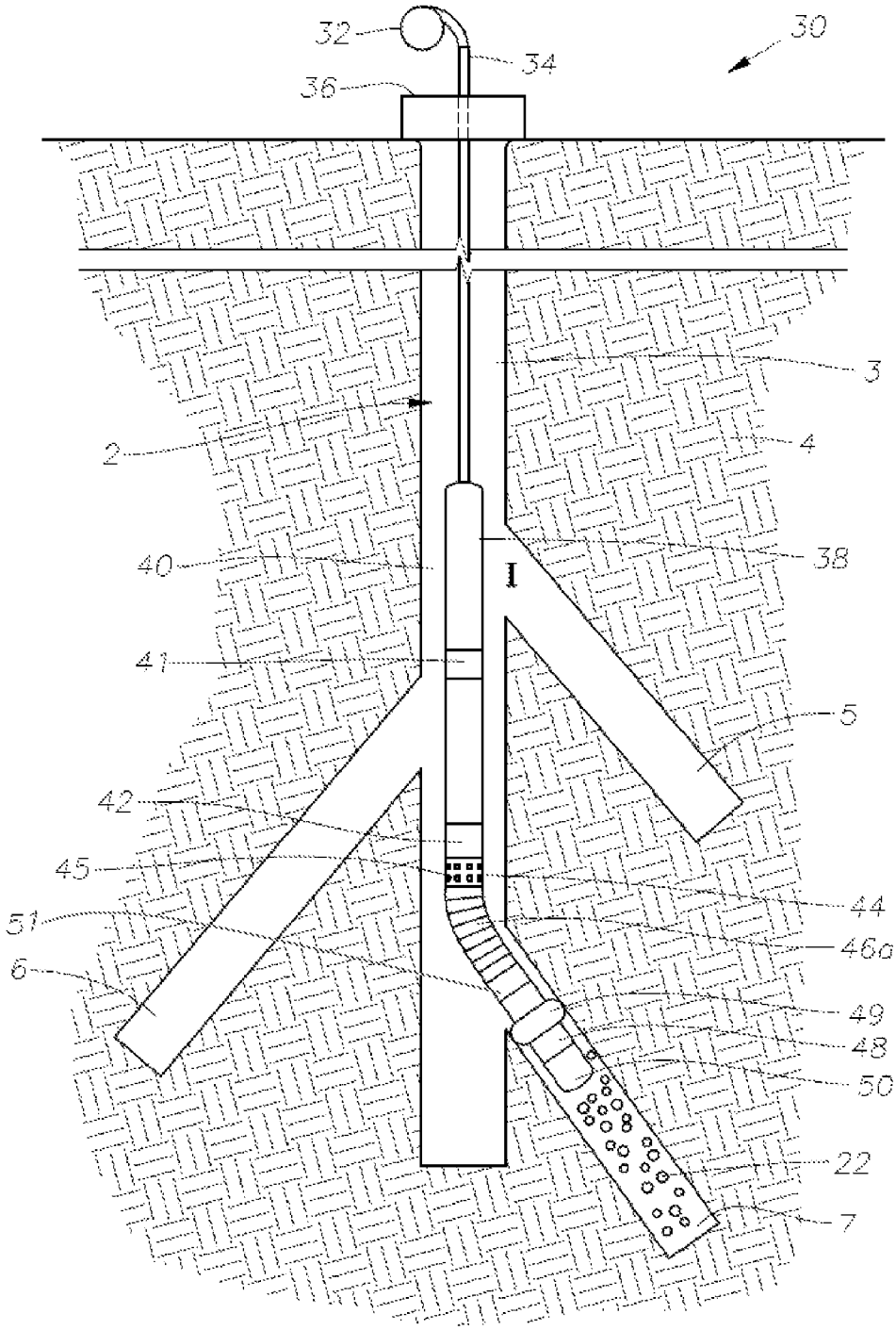

FIG. 4 illustrates the embodiment of FIG. 3 shown with the tool 38 urged deeper into the lateral wellbore 7. Also shown in FIG. 4 is the optional plug section 48 activation; activating the plug section 48 deploys a seal 49 extending from the plug section 48. The seal 49 radially circumscribes the plug section 48 and projects out to the wellbore wall $W_I$ in the lateral wellbore 7. The seal 49 is in sealing engagement with the wellbore wall $W_I$ and prevents fluid flow across the plug section 48. Installing and activating the plug section 48 in the lateral wellbore 7 eliminates water and/or gas 22 contribution from the lateral wellbore 7 into the primary wellbore 3.

Figure 5:
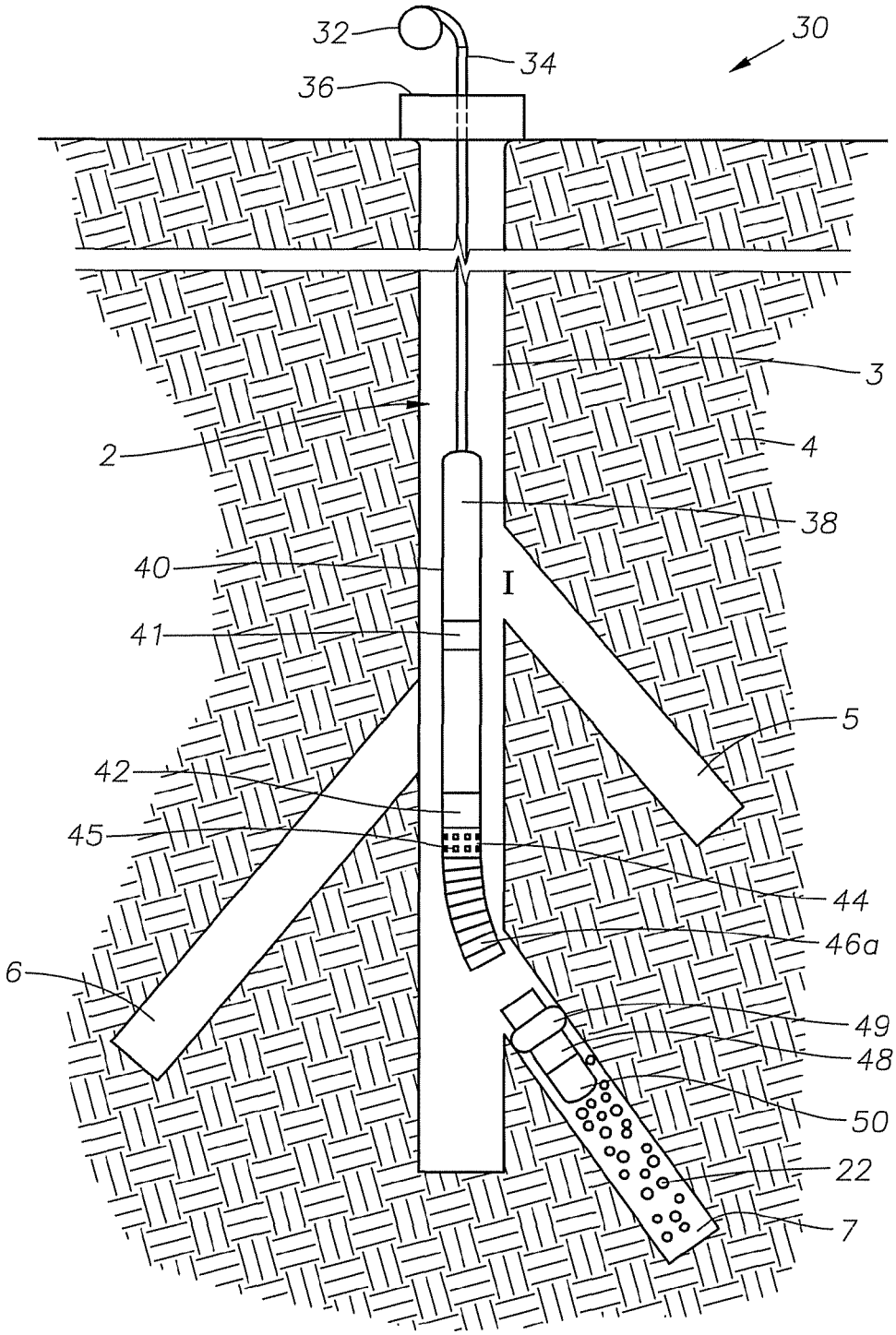

The plug section 48 is separatable from the tool 38 by a frangible link 51, either within the plug section 48 or between the plug section 48 and the remaining portion of the tool 38. Shown in FIG. 5 the plug section 48 is separated from the remaining portion of the tool 38 leaving the plug section 48 and guide shoe 50 in the lateral wellbore 7. The remaining portion of the tool 38 is retrievable from within the primary wellbore 3. The frangible link 51 can be designed to fail under a pulling shear force. Optionally, an explosive or disintegrating device can be employed for separating the plug section 48 from the tool 38.

Figure 6:
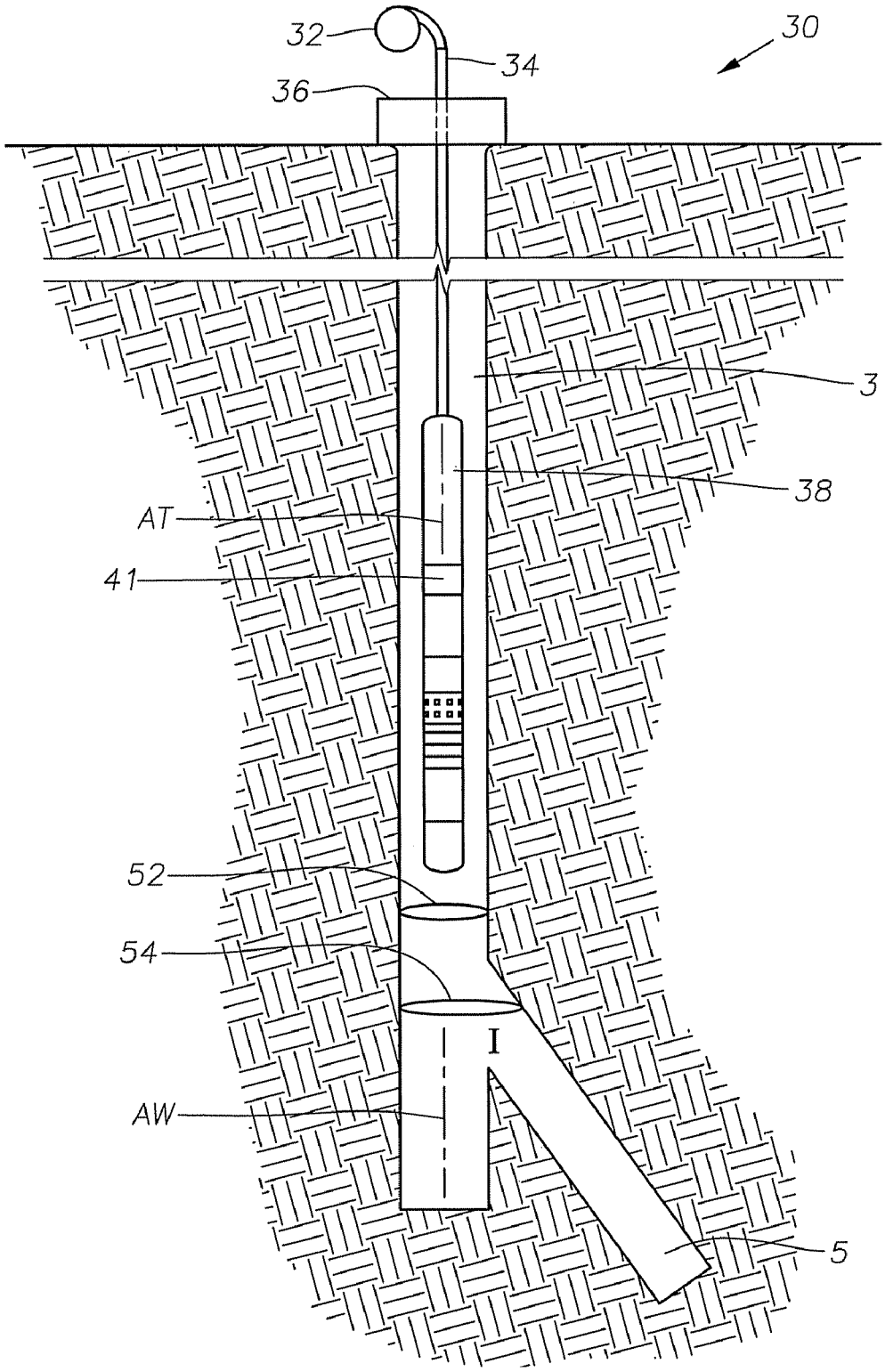
FIG. 6 depicts a downhole tool in accordance with the present disclosure sensing within the wellbore.

FIG. 6 is a side schematic view of an embodiment of the tool 38 within the primary wellbore 3. Signal paths 52, 54 are provided within the wellbore 2 illustrating an example of a seismic signal direction. Path 52 represents a signal from the acoustic transducers 45 directed to the wellbore wall $W_P$ within the primary wellbore 3. Similarly, path 54 illustrates acoustic signal propagation when directed to the wall $W_L$ within the lateral wellbore. In the example of FIG. 6, the lateral wellbore is lateral wellbore 5.

Figure 7:
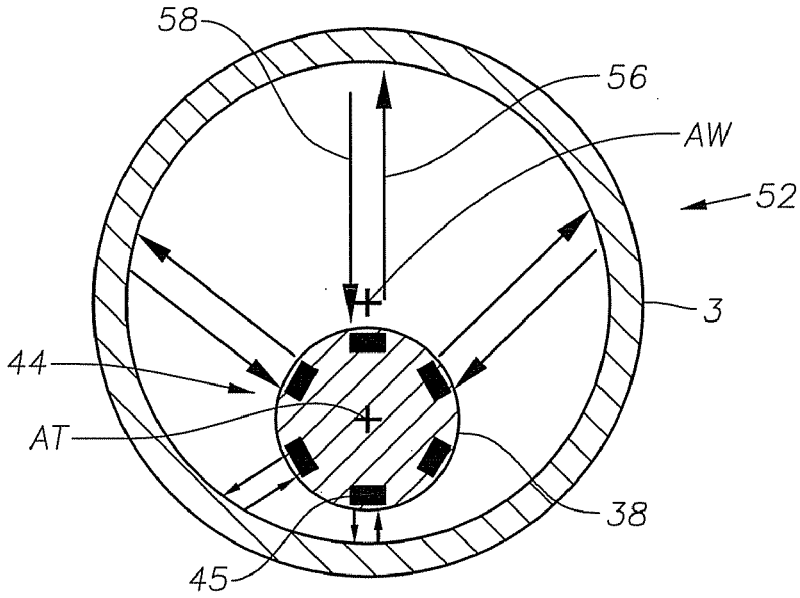
FIG. 7 is an overhead view of the downhole tool of FIG. 6 in a primary wellbore.

FIG. 7 represents an overhead cutaway view demonstrating an example of signal travel from the sensors 45 and their ensuing reflections from the wellbore wall $W_P$. The sensors 45 are provided at multiple positions around the tool axis $A_T$ within the lateral detector 44. Although the tool 38 is oriented having its axis $A_T$ set apart from the primary wellbore axis $A_W$, embodiments exist wherein the axes are substantially aligned. In the embodiment of FIG. 7, acoustic signals generated within the primary wellbore 3 are represented by arrows 56 shown directed towards the primary wellbore 3 wall $W_P$. The acoustic signals 56 reflect from the wall $W_P$ and form a reflected signal 58. In the embodiment shown, the acoustic signals 56 are oriented away from the tool 38 in a direction perpendicular to the axis $A_T$. Consequently, the reflected signal 58 propagates in a direction substantially along the path of the acoustic signal 58 and towards the tool 38. However, other embodiments are available, wherein the acoustic path 56 extends along a path generally oblique to one of the tool axis $A_T$, the well axis $A_W$, or both.

By estimating the fluid properties within the well 2, the sound speed within the wellbore fluid can be estimated, thereby providing an estimated value of distance between each of the sensors 45 and the wellbore wall $W_P$. These distances can be calculated within the processor 41 optionally provided within the tool 38, stored within the tool 38, or communicated to the surface for real time analysis. Subsequent cycles of acoustic signal generation and detection can be performed at different depths within the wellbore 2. This can be an incremental or a continuous fashion. It is believed it is well within the capabilities skilled in the art to devise a suitable method of disposing the tool 38 within the wellbore while making acoustic estimations within the wellbore. Using the data collected the wellbore dimensions adjacent the tool 38 can be estimated.

Figure 8:
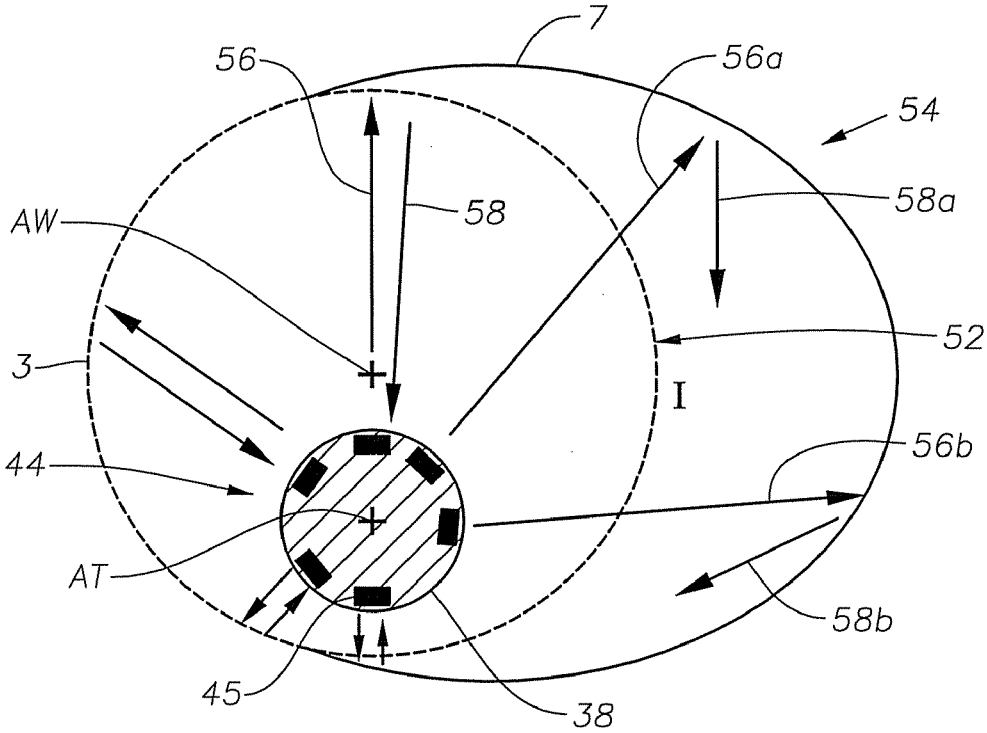
FIG. 8 illustrates in overhead view the downhole tool of FIG. 6 adjacent a lateral wellbore.

FIG. 8 illustrates an overhead schematic view of the tool 38 in the wellbore, wherein the lateral detector 44 is disposed adjacent the intersection I to form the acoustic path 54. As shown, generated signals 56 directed towards the wellbore wall $W_P$ and the primary wellbore will generate reflected signals 58 similar to those of FIG. 7, both in direction and arrival time to the sensor 45. However, generated signals 56*a*, 56*b* directed towards the intersection, are shown extending past the line representing the primary wellbore wall $W_P$ into the wellbore wall lining the lateral wellbore 5. The reflected signals 58*a*, 58*b* produced by reflecting signals 56*a*, 56*b* on the wellbore wall $W_L$ within the lateral wellbore 5 will, according to Snell's law, have a primary component directed at an angle with respect to the sensor 45 that generated the signals 56*a*, 56*b*. Accordingly, magnitude and travel time detected for the reflected signals 58*a*, 58*b* from the lateral wellbore wall $W_L$ will differ from the travel time and signal magnitude a signal reflected from the primary wellbore wall $W_P$. As such, the location of the intersection I between the primary wellbore 3 and any of the lateral wellbores may be identified through analyzing reflected acoustic signal data.

Optionally, a database of reflected signal data can be created empirically, through actual recording when disposing a tool downhole, as well as during the particular operation when attempting to identify a wellbore lateral. By correlating the response of acoustics within the intersection area with the measured depth of the tool 38 can provide an estimated location of the intersection I within the wellbore 2.

Alternative embodiments include a single sensor 45 on the tool 38, wherein the tool may be rotated during use. Optionally, in a pair of transducers, such as an acoustic transmitter and an acoustic receiver may be included on a tool at a single location. Although sensors 45 are shown in six locations around the tool 38, multiple other embodiments exist having less or more than six locations for sensors on a tool 38.

In an alternative embodiment, the downhole tool 38 may include a lateral detector 44. In other embodiments one or more additional features described above, in any combination, can be included with the lateral detector 44, such as the processor 41, the sensor 42, the orienting sub 46, the plug section 48, and the guide shoe 50. Embodiments of the tool 38 may alternatively include wellbore exploration devices, perforating devices, and fracturing systems.

While the invention has been shown or described in only some of its forms, it should be apparent to those skilled in the art that it is not so limited, but is susceptible to various changes without departing from the scope of the invention.

What is claimed is:

1. A method of maintaining a wellbore, the wellbore formed through a formation thereby defining a wellbore wall at the wellbore outer periphery, wherein the wellbore includes a lateral wellbore intersecting a primary wellbore, the method comprising:

a. disposing a downhole tool into the primary wellbore thereby forming an annulus between the tool and the wall in the primary wellbore, the tool having an acoustic transducer;

b. generating an acoustic signal using the transducer, the signal being directed from the tool to the wellbore wall so that when the signal reflects from the wellbore wall a reflection signal is formed, wherein a reflection signal from the wall in the lateral wellbore is identifiable;

c. receiving the reflection signal;

d. moving the transducer in an axial direction along the wellbore axis;

e. repeating steps (b)-(d) to create a collection of received signals;

f. identifying a reflection from the wall in the lateral wellbore from the collection of received signals and estimating where the lateral wellbore intersects with the primary wellbore; and g. inserting the downhole tool into a selected lateral wellbore to isolate the primary wellbore from fluids in the selected lateral wellbore.

2. The method of claim 1, the tool further having a water and/or gas sensor, the method further comprising analyzing fluid in the wellbore for the presence of water and/or gas.

3. The method of claim 2 further comprising, determining whether the lateral wellbore produces water and/or gas based on the results of estimating a location where the lateral wellbore intersects with the primary wellbore and sensing water and/or gas in the wellbore fluid proximate to the estimated location of where the lateral wellbore intersects with the primary wellbore.

4. The method of claim 1, the tool further having a bendable sub, the method further comprising, activating the bendable sub so that activating the bendable sub bends a lower portion of the tool into alignment for insertion into a lateral wellbore.

5. The method of claim 4, wherein step (b) comprises directing the acoustic signals in a number of directions from the tool and determining the elapsed time for the receiving signals to be received.

6. The method of claim 1, wherein the tool further comprising a wellbore seal, and wherein the step of isolating the lateral wellbore from primary wellbore comprises activating the wellbore seal.

7. The method of claim 6 further comprising, separating the portion of the tool having the wellbore seal from the remaining portion of the tool, removing the remaining portion of the tool from the lateral wellbore, and leaving the portion of the tool having the wellbore seal in the lateral wellbore.

8. A downhole tool insertable into a wellbore having a primary wellbore intersecting with a lateral wellbore, the tool comprising:

a water and/or gas sensor to sense the presence of water and/or gas flowing from the lateral wellbore;

a sensor to determine a location where the lateral wellbore intersects with the primary wellbore;

a bendable orienting sub that bends a lower portion of the tool relative to an upper portion to enter the lateral wellbore;

a wellbore seal in the lower portion of the tool, which when activated seals the lateral wellbore; and a frangible section that releases the lower portion of the tool from the remaining portion to allow the tool to be retrievable while the wellbore seal remains in the lateral wellbore.

9. The tool of claim 8 further comprising an acoustic signal transmitting and receiving system that emits acoustical signals that are reflected from a wellbore wall to determine the location of a lateral wellbore.

10. A wellbore system for investigating a wellbore, the wellbore having a primary well, a lateral well intersecting the primary well, and a wall on the primary well inner periphery and lateral well inner periphery, the system for estimating where the lateral well intersects the primary well, the system comprising:

a sonde disposable into the wellbore and having an end insertable into the lateral well for sealing the lateral well from. the primary well;

an acoustic array provided with the sonde, the array comprising an acoustic transmitter and a corresponding acoustic receiver, the acoustic transmitter positioned so that when it generates an acoustic signal the acoustic signal is directed away from the sonde in a plurality of lateral directions to an adjacent wellbore wall, wherein the acoustic signal contacts the wellbore wall on one of the primary well inner periphery or lateral well inner periphery and reflects from the wellbore wall to form a reflection signal receivable by the acoustic receiver; and a processor in data communication with the array, the processor configured to analyze data communicated from the array to determine if the reflection signal was by the acoustic signal reflecting from the primary wellbore or the lateral wellbore to thereby estimate the location where the lateral wellbore intersects with the primary wellbore.

11. The system of claim 10, wherein the end insertable into the lateralwell for sealing the lateral well from the primary well includes a sealing sub with the sonde having a sealing member outwardly expandable into sealing engagement with a wellbore wall.

12. The system of claim 10, further comprising an orientation sub with the sonde, the orienting sub bendable to angle a lower portion of the sonde with respect to the remaining portion of the sonde.

13. The system of claim 10, further comprising a sensor with the sonde to sense water and/or gas within fluid in the wellbore.

14. A method of investigating a wellbore having a primary well intersected by lateral well and estimating where in the wellbore the lateral well intersects the primary well the wellbore having a wall along the primary well inner surface and the lateral well inner surface, the method comprising:

a. deploying a downhole tool having a seal section with a deployable seal in the primary well and generating an acoustic signal within the primary well;

b. directing the acoustic signal to the wellbore wall so that a reflection signal is formed from the acoustic signal reflecting from the wellbore wall;

c. receiving the reflection signal with the tool;

d. comparing the reflection signal with a reference signal, where the reference signal represents an expected reflection signal from the primary wellbore;

e. determining if the reflection signal was formed by reflecting the acoustic signal from the wellbore wall in the lateral well based on the step of comparing the reflection signal with the reference signal;

f. estimating the lateral well and primary well intersection based on the step of determining if the reflection signal was formed by reflecting the acoustic signal from the wellbore wall in the lateral well; and g. isolating the primary wellbore from fluids in a designated lateral wellbore by inserting the seal portion of the downhole tool into the designated lateral wellbore and activating the deployable seal.

15. The method of claim 14, further comprising repeating step (a) thereby generating multiple acoustic signals along different lateral paths from and surrounding the tool.

16. The method of claim 14, further comprising sensing for water and/or gas in the wellbore with the tool.

17. The method of claim 16 further comprising, determining if the water and/or gas sensed is originates from the lateral well or the primary well by sensing for water and/or gas in the wellbore proximate to the estimate of the intersection of the primary well and the lateral well.

18. The method of claim 17 further comprising positioning at least part of the tool in the lateral wellbore and plugging the lateral well.

19. The method of claim 18, wherein plugging is performed by activating a seal carried by the tool, and after activated, the tool is retrieved, leaving the seal in the lateral well.

20. The method of claim 18, wherein the step of positioning a part of the tool into the lateral well comprises, while the tool is in the primary well, bending a lower portion of the tool and lowering the tool into the lateral well.

* * * * *

UNITED STATES PATENT AND TRADEMARK OFFICE

CERTIFICATE OF CORRECTION

PATENT NO. : 8,091,633 B2
APPLICATION NO. : 12/396763
DATED : January 10, 2012
INVENTOR(S) : Mohammed Najim Al-Khamis It is certified that error appears in the above-identified patent and that said Letters Patent is hereby corrected as shown below:

In column 7, line 53, after the word 'from', please delete "."

In column 8, line 6, after the word 'the', please delete the words "lateralwell," and add --lateral well--; at line 50, after the word 'sensed', please delete the word "is"

Signed and Sealed this
Tenth Day of April, 2012

David J. Kappos

David J. Kappos
*Director of the United States Patent and Trademark Office*